US007632134B2

(12) United States Patent
Su et al.

(10) Patent No.: US 7,632,134 B2
(45) Date of Patent: Dec. 15, 2009

(54) ELECTRICAL CONNECTOR HAVING PROTECTIVE MEMBER

(75) Inventors: Ping-Sheng Su, Tu-Cheng (TW); Chiao Chen, Tu-cheng (TW); Li-Zhi Huang, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/824,761

(22) Filed: Jul. 2, 2007

(65) Prior Publication Data

US 2008/0003841 A1 Jan. 3, 2008

Related U.S. Application Data

(63) Continuation-in-part of application No. 11/481,644, filed on Jul. 5, 2006, now Pat. No. 7,306,479, and a continuation-in-part of application No. 11/481,152, filed on Jul. 3, 2006, now Pat. No. 7,429,188.

(30) Foreign Application Priority Data

Jun. 30, 2006 (CN) ..... 2006 2 0074604

(51) Int. Cl.
*H01R 3/00* (2006.01)

(52) U.S. Cl. ..... 439/490

(58) Field of Classification Search ..... 439/456, 439/459, 465, 466, 467, 490, 610, 752, 595, 439/607.01, 607.27, 607.41, 607.55
See application file for complete search history.

(56) References Cited

U.S. PATENT DOCUMENTS

| | | | | |
|---|---|---|---|---|
| 6,796,843 | B1 | 9/2004 | Ryan et al. | |
| 6,814,626 | B2 * | 11/2004 | Wen-Yao | 439/700 |
| 7,201,613 | B2 * | 4/2007 | Sasaki | 439/700 |
| 7,329,151 | B2 * | 2/2008 | Wu | 439/610 |

FOREIGN PATENT DOCUMENTS

TW M264732 5/2005

* cited by examiner

*Primary Examiner*—Edwin A. Leon
(74) *Attorney, Agent, or Firm*—Wei Te Chung; Andrew C. Cheng; Ming Chieh Chang

(57) ABSTRACT

An electrical connector includes a terminal block defining a plurality of receiving passageways extending therethrough, a plurality of terminals respectively received in the terminal block and a protective member assembled to the front side of the terminal block. Each terminal defines a media portion positioned in the corresponding receiving passageways and a contacting portion extending forwardly from the media portion and beyond the corresponding receiving passageways. The protective member further defines a plurality of channels corresponding to the receiving passageways for entirely receiving the plurality of contacting portions of the terminals.

16 Claims, 5 Drawing Sheets

ELECTRICAL CONNECTOR HAVING PROTECTIVE MEMBER

CROSS-REFERENCE TO RELATED APPLICATION

This application is a CIP (Continuation-In-Part Application) of one of these applications. U.S. patent application Ser. No. 11/481,644, filed on Jul. 5, 2006 now U.S. Pat. No. 7,306,479, and entitled "CABLE CONNECTOR ASSEMBLY WITH IMPROVED STRAIN RELIEF MEMBER", and U.S. patent application Ser. No. 11/481,152, filed on Jul. 3, 2006 now U.S. Pat. No. 7,429,188, and entitled "CABLE CONNECTOR ASSEMBLY WITH STATUS INDICATOR MEANS", which has the same applicant and assignee as the present invention. The disclosure of related application is incorporated herein by reference.

BACKGROUND OF THE INVENTION

1. Field of the Invention

The present invention generally relates to an electrical connector, and more particularly to an electrical connector used for power transmission.

2. Description of Related Art

A conventional electrical connector usually comprises a housing and a plurality of terminals received in said housing, as disclosed in TW Patent No. M264732. However, the terminal are partially exposed outside of the housing, and this brings about some problems, such as short circuit caused by willful or unwillful touch, easy to be dirtied or destroyed by unexpected force. Please refer to U.S. Pat. No. 6,796,843 B1 FIG. 2, it discloses a plurality of pins 20 enclosed by a third-row section 22. The third-row section 22 protects the pins 20 from being destroyed. However, in some circumstances, the unintentional entry of a conductive thing into the third-row section 22 may cause short circuit and even destroys the whole device equipped this kind of electrical connector. Therefore, a newly designed connector is desired to resolve said problems.

BRIEF SUMMARY OF THE INVENTION

Accordingly, an object of the present invention is to provide an electrical connector with improved structure for achieving more reliable connection.

In order to achieve the above-mentioned object, an electrical connector in accordance with the present invention comprises a terminal block defining a plurality of receiving passageways extending therethrough, a plurality of terminals respectively received in the terminal block and a protective member assembled to the front side of the terminal block. Each terminal defines a media portion positioned in the corresponding receiving passageways and a contacting portion extending forwardly from the media portion and beyond the corresponding receiving passageways. The protective member further defines a plurality of channels corresponding to the receiving passageways for entirely receiving the plurality of contacting portions of the terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
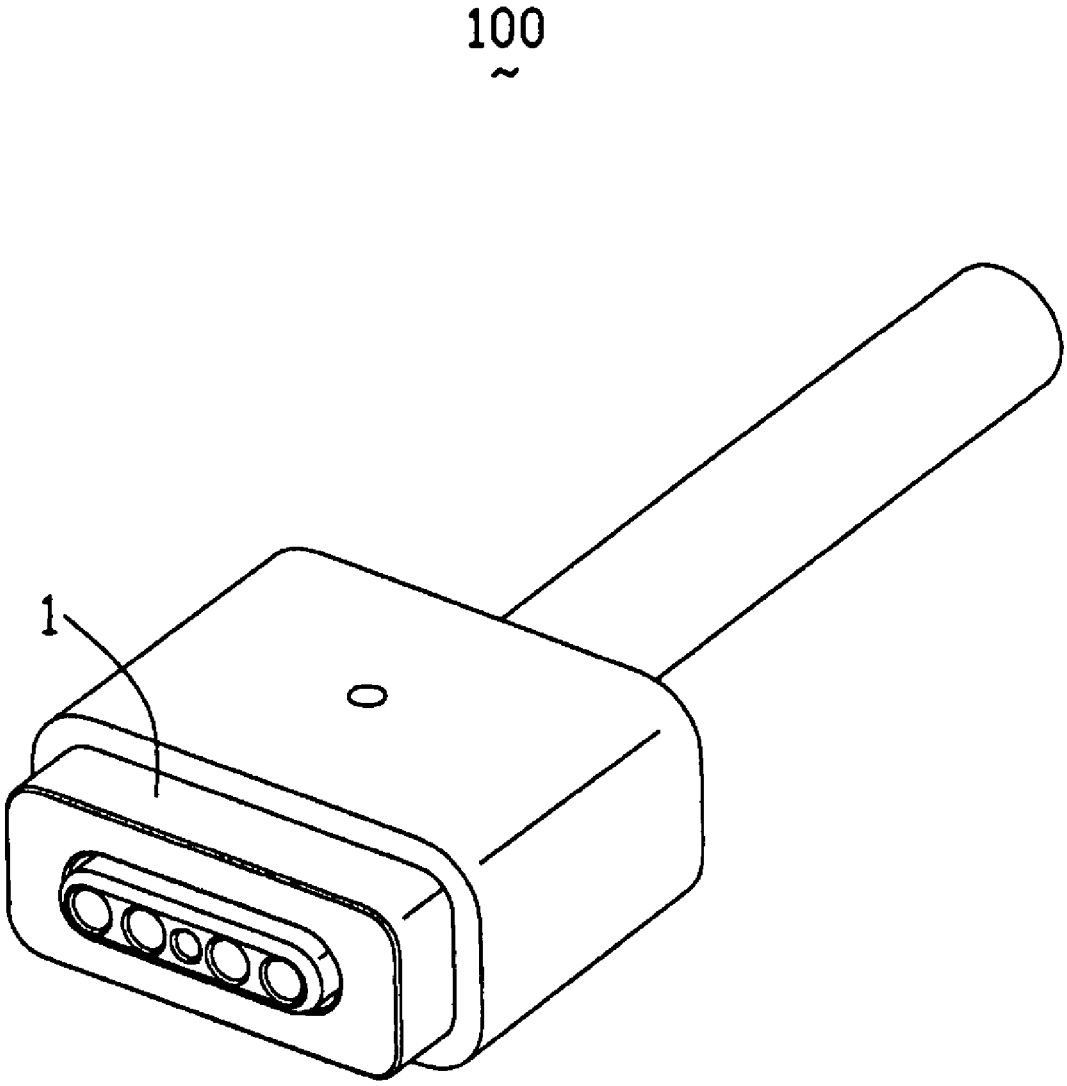
FIG. 1 is an assembled, perspective view of an electrical connector in accordance with the present invention.

Reference will now be made to the drawing figures to describe the present invention in detail.

Referring to FIGS. 1-5, an electrical connector 100 in accordance with the present invention comprises an insulative housing 1, a plurality of conductive terminals 2 received in the housing 1, a circuit board 3 assembled to a rear end of the housing 1 and electrically connecting to the terminals 2, an integrated circuit (IC) 41 and a Low Emitting Diode (LED) 42 together positioned on the circuit board 3, a cable 5 electrically connecting to a rear end of the circuit board 3 and a cover 6 enclosing the periphery of the housing 1 and the circuit board 3.

Figure 4:
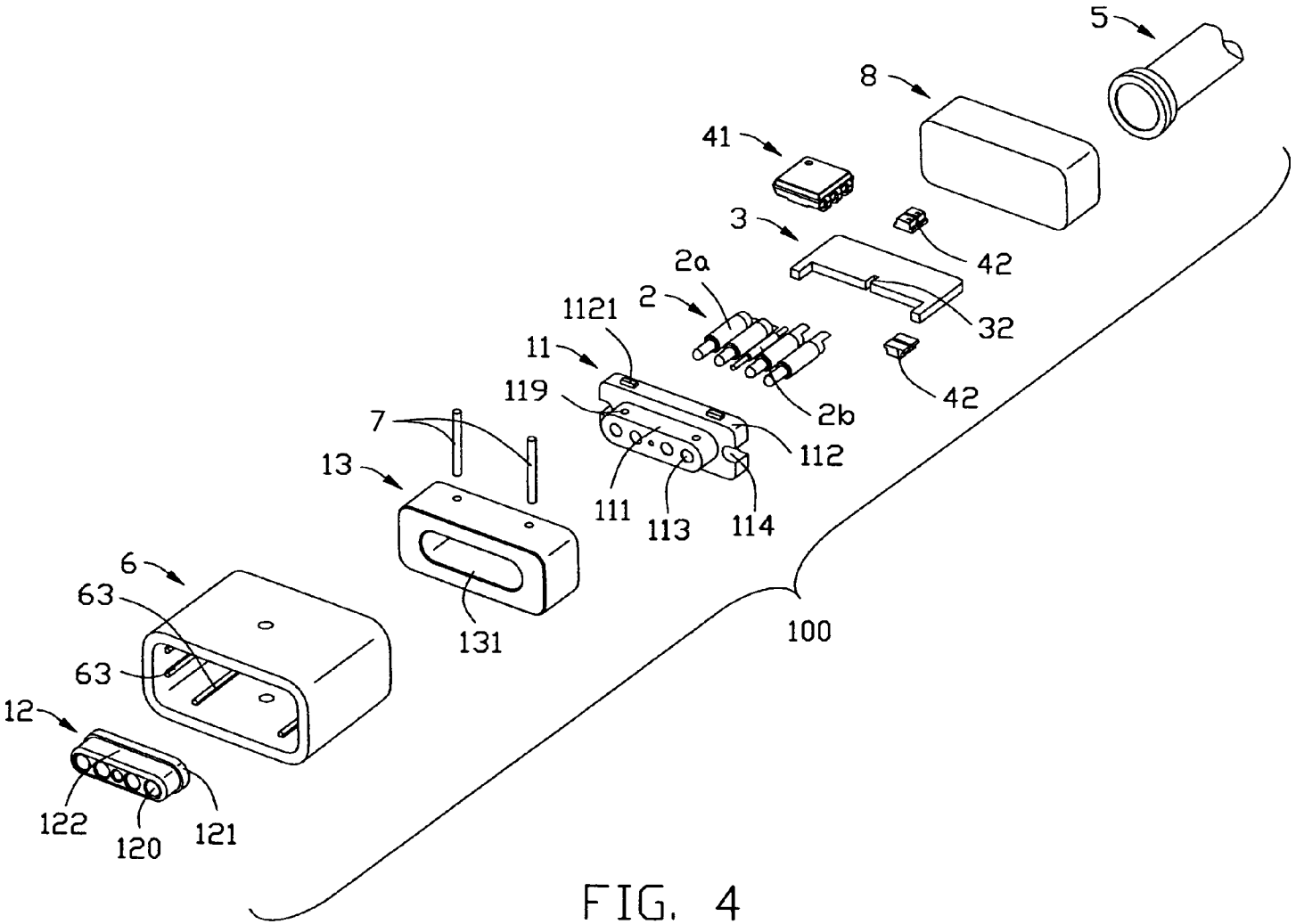
FIG. 4 is an exploded, perspective view of FIG. 1.
Figure 5:
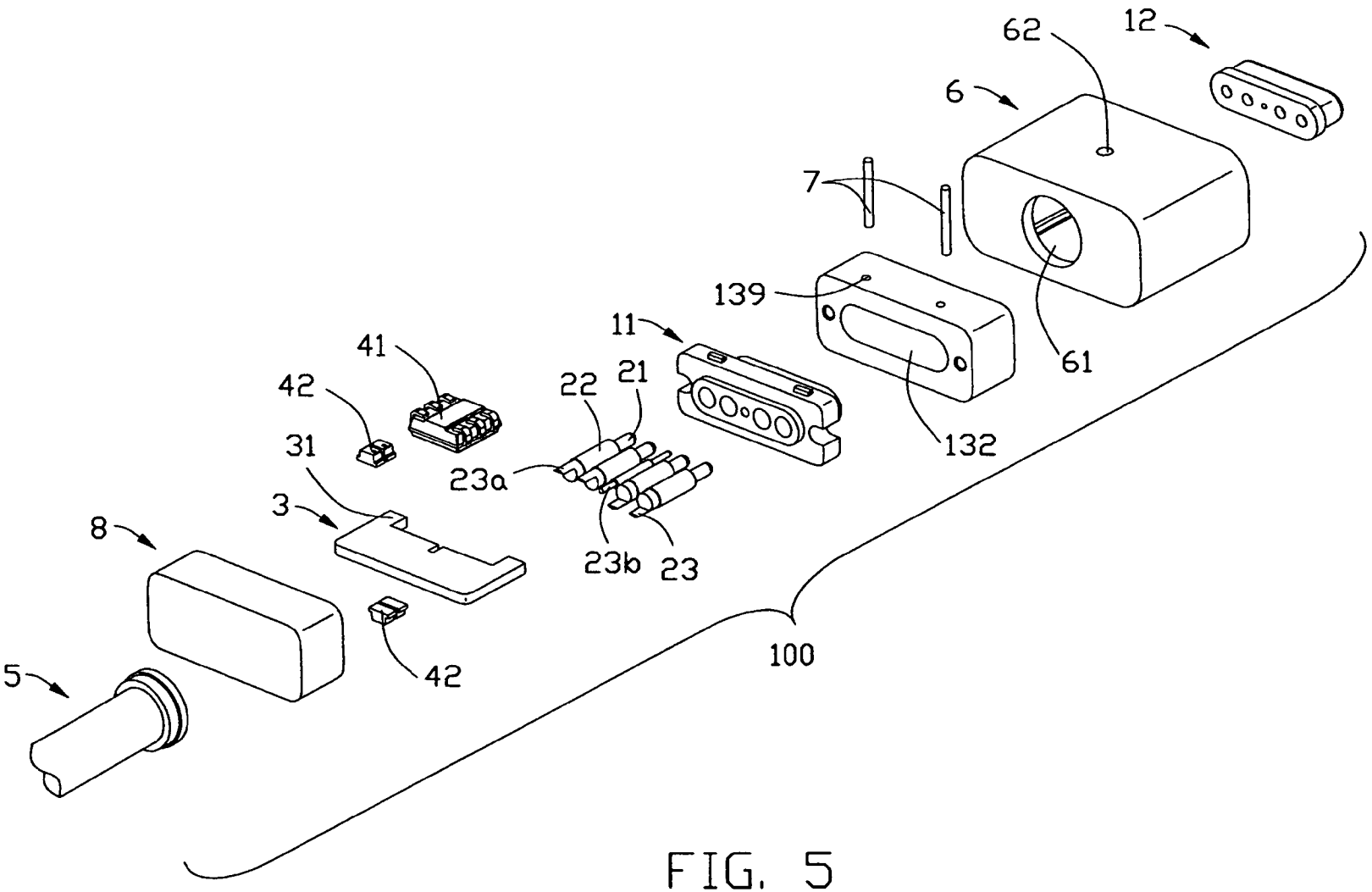
FIG. 5 is a view similar to FIG. 4, but viewed from a different aspect.

Now referring to FIGS. 4-5, the terminals 2 are of POGO-type, and consist of four power terminals 2*a* and a center detective terminal 2*b* located between the power terminals 2*a*. The four power terminals 2*a* are arranged into two groups, and each group comprises a power terminal and a ground terminal. Each terminal 2 comprises a column-shape contacting portion 2 with a relatively small diameter, a column-shape media portion 22 with a relatively large diameter, and an end portion 23 extending from rear end of the media portion 22 with an arc-shape and comprising a flat engaging surface structure electrically connecting with the circuit board 3. The detective terminal 2*b* has the same structure as that of the power terminal 2*a* except each portion thereof has a smaller diameter than that of the power terminal 2*a*. In addition, the end portion 23 of the detective terminal 2*b* is of columnar-shape.

The housing 1 comprises a terminal block 11 for positioning the terminals 2, a protective member 12 located at front end of the terminal block 11 and defining a plurality of channels 120 and, a front cover 13 enclosing the terminal block 11 and the protective member 12.

The terminal block 11 comprises a base portion 112, a tongue portion 111 extending forwardly from a front end of the base portion 111 and a plurality of terminal receiving passageways 113 extending through the base portion 112 and the tongue portion 111 respectively corresponding to the terminals 2. The tongue portion 111 further defines a pair of first holes 119 extending therethough from upper surface to bottom surface thereof. The terminals 2 are inserted from the rear end of terminal block 11 with the contacting portions 21 forwardly extending out of the passageways 113, the media portions 22 fully engaging with the passageways 113 and the end portions 23 exposed out of the rear end of the terminal block 11 and electrically soldering with the circuit board 3. In alternative embodiments, the terminals 2 may be molded with the terminal block 11.

The protective member 12 is made of dielectric material. The protective member 12 is of step-shape, substantially elliptical shape and defines an enlarged portion 121, a forward portion 122 extending forwardly from the enlarged portion 121 and the plurality of channels 120 extending through the protective member 12 with dimensions larger than that of the contacting portions 21 of the terminals 2 and smaller than that of the media portions 22 of the terminals 2. Therefore, the channels 120 allow the contacting portions 21 to enter therein and stop the media portions 22 from entering therein.

The front cover 13 is made from conductive or magnetic material capable of being attracted by a complementary connector. The front cover 1 is substantially rectangular shape, defines an elliptical-shape receiving cavity 132 recessed forwardly from a rear surface thereof for accommodating the enlarged portion 121 of the protective member 12 and the tongue portion 111 of the terminal block 11 and an elliptical front opening 131 recessed rearwardly from a front surface thereof to communicate with the receiving cavity 132 for allowing the forward portion 122 projecting out thereof. The receiving cavity 132 and the front opening 131 together define a mating port (not labeled). The receiving cavity 132 has a large size than that of the front opening 131, thus, forming a step portion therebetween (not shown). The protective member 12 is moved into the receiving cavity 132 of the front cover 13 from rear side thereof, with the enlarged portion 121 resisting against the step portion, and the forward portion 122 projecting out of the front opening 131. Then, the tongue portion 111 of the terminal block 11 is assembled into the receiving cavity 132 and resists against the enlarged portion 121.

Figure 2:
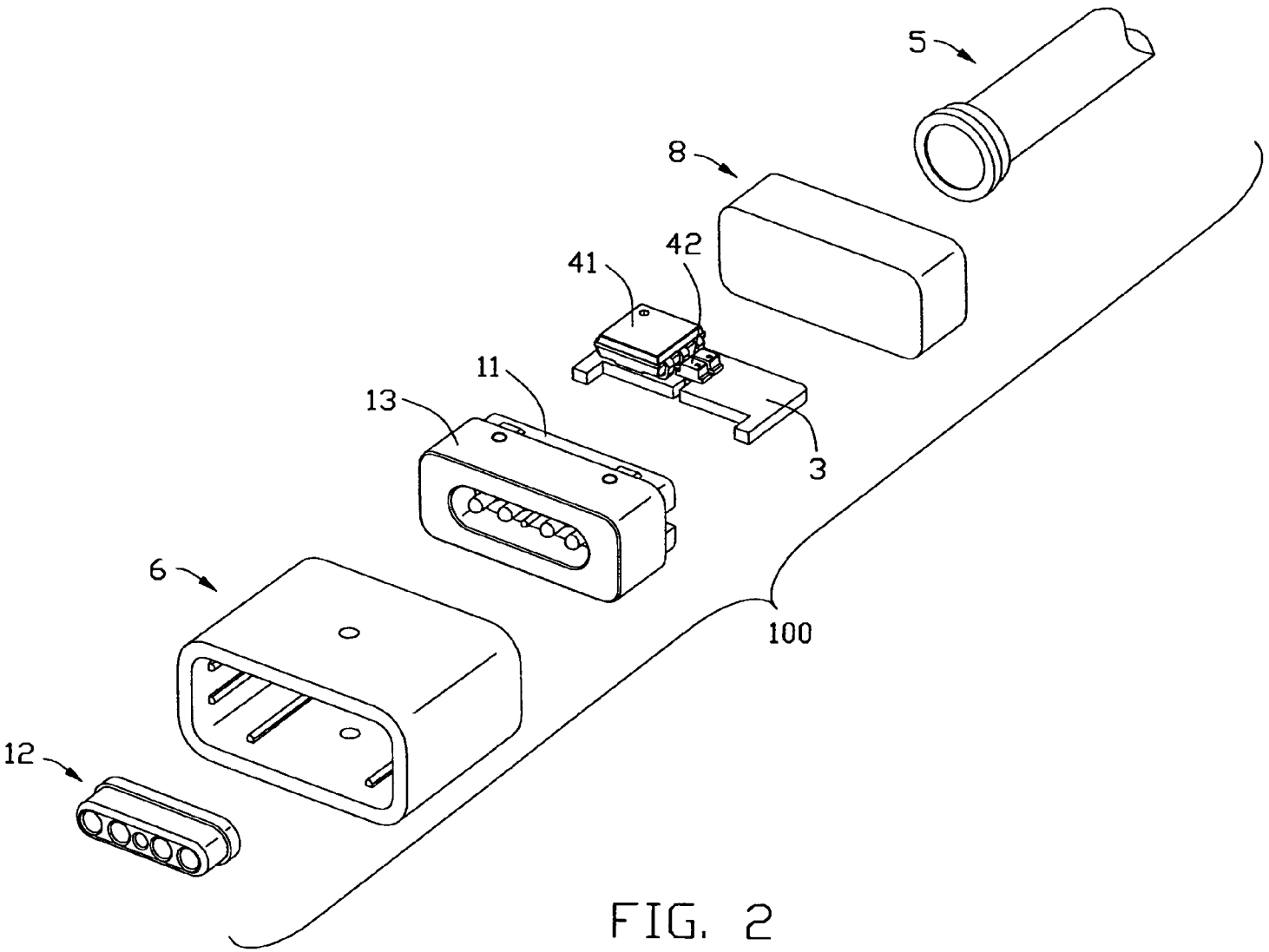
FIG. 2 is a partially exploded, perspective view of FIG. 1.
Figure 3:
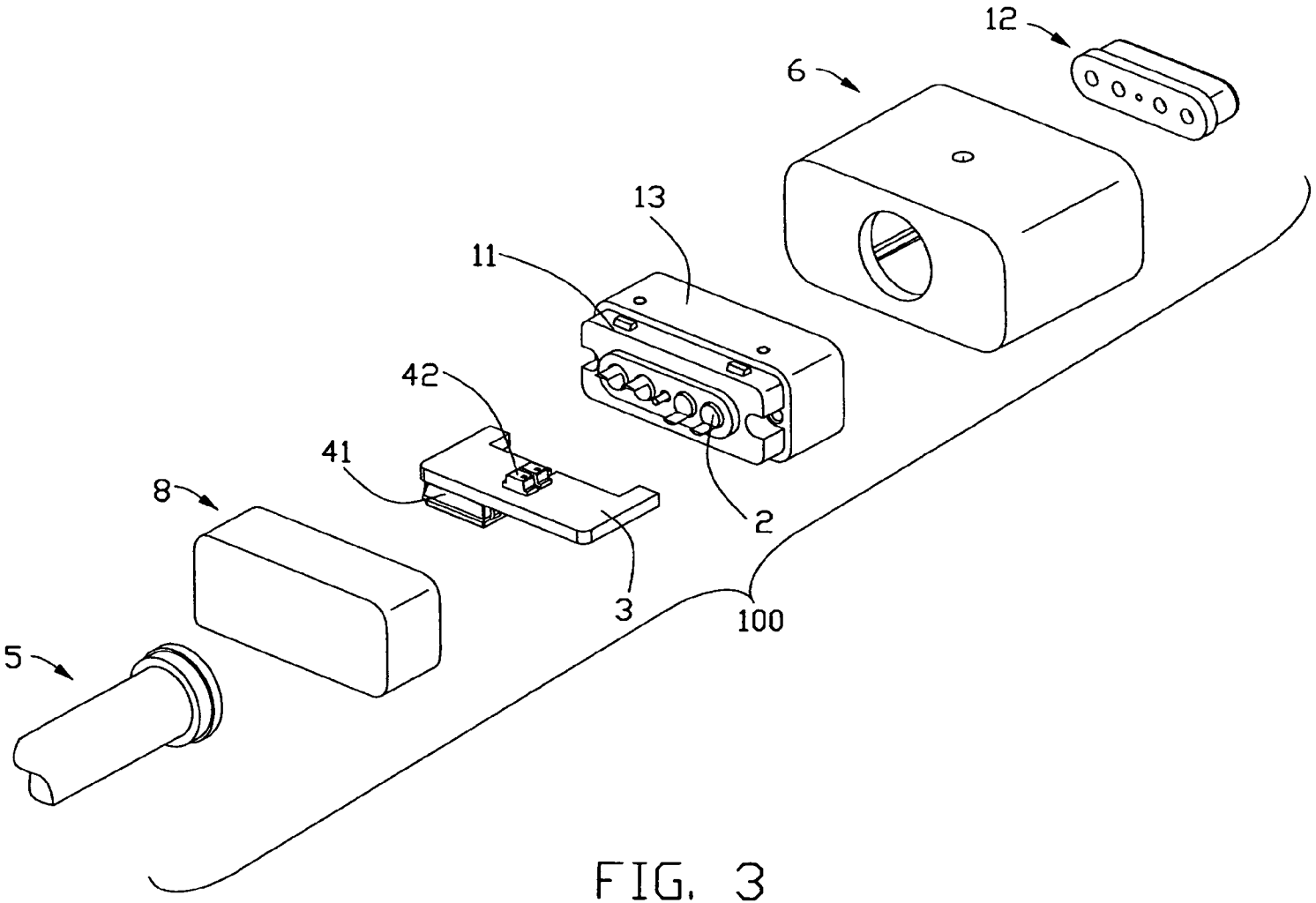
FIG. 3 is a view similar to FIG. 2, but view from a different aspect.

Referring to FIGS. 4-5 and in conjunction with FIGS. 2-3, the front cover 13 also defines a pair of second holes 139 corresponding to the first holes 119 of the tongue portion 111 of the terminal block 11 and respectively recessed from a top surface to an opposite bottom surface thereof and locating adjacent to the rear surface thereof. The electrical connector according to the present invention further comprises a pair of retaining pins 7 for positioning the tongue portion 111 of the terminal block 11 within the receiving cavity 132 of the front cover 13 by the pair of first holes 119 and the pair of second holes 139. In the meanwhile, the base portion 112 is exposed and located at the rear end the front cover 13. In alternative embodiment, the protective member 12 may be integrally over-molded with the tongue portion 111 of the terminal block 11.

The circuit board 3 is of rectangular shape, located behind the terminal block 11, and comprises a plurality of conductive elements (not shown). The circuit board 3 defines a pair of stretching arms 31 at the two front sides thereof, respectively. The base portion 112 of the terminal block 11 also respectively defines a pair of semi-circular notches 114 at the two sides thereof to cooperate with the stretching arms 31. The end portions 23 of the power terminals 2*a* spaced by the detective terminal 2*b* are arranged into two groups which are opposite to each other for respectively soldering on the upper and lower surfaces of the circuit board 3. The circuit board 3 further defines a slit 32 extending rewardly from a middle of a front edge thereof to electrically connect with the pair of LEDs 42 arranged on opposite surfaces of the circuit board 3.

The IC 41 is electrically soldered on the circuit board 3 to drive the LEDs 42 to emit different light for indicating the current status of the electric circuit, such as charging and fully charged.

The cable 5 comprises a plurality of inner conductors (not shown) soldered with the conductive elements disposed on the circuit board 3. An inner casing 8 is over-molded with the base portion 112 of the terminal block 11 and the circuit board 3. The inner casing 8 is molded or injected from transparent or semitransparent material for transmitting the light emitted by the LEDs 42. The base portion 1 12 forms a plurality of protrusions 1121 at the upper and lower sides thereof for securely positioning with the inner casing 81.

The cover 6 is made of resin material and of rectangular-receptacle shape, and defines a receiving space (not labeled) accommodating the above assembly, an opening 61 formed at rear side thereof for permitting the cable 5 to pass through and a pair of circular holes 62 respectively located at top wall and bottom wall thereof for facilitating to watch the light emitted by LEDs 42. The cover 6 further defines a plurality of ribs 63 on the inner periphery wall thereof for pressing on the outer periphery of the inner casing 8, and the inner casing 8 is daubed by gluewater, all of which would securely tie the two together.

In assembly, the protective member 12 is moved toward the receiving cavity 132 of the front cover 13 from a rear side thereof, with the enlarged portion 121 resisting against the step portion and being stopped from disengaging with the front cover 13, and the forward portion 122 projecting out of the front opening 131, The plurality of terminals 2 are assembled to the terminal block 11 with the contacting portions 21 forwardly extending out of the passageways 113, the media portions 22 interferentially engaging with the passageways 113, and the end portions 23 exposed out of the rear end of the terminal block 11 and electrically soldering with the circuit board 3. Then, the terminal block 11 with the terminals 2 is assembled into the receiving cavity 132 of the front cover 13 and engages with the protective member 12, with the passageways 113 corresponding to the channels 120. The dimension of the channels 120 are respective larger than that of the contacting portions 21 of the terminals 2 and smaller than that of the media portions 22 of the terminals 2. Therefore, the channels 120 can allow the contacting portions 21 to enter therein and stop the media portions 22 from entering therein. Accordingly, each contacting portion is securely and protectively positioned in the corresponding channel.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a terminal block defining a plurality of receiving passageways extending therethrough;

a plurality of terminals respectively received in the terminal block and each defining a media portion positioned in the corresponding receiving passageways and a contacting portion extending forwardly from the media portion and beyond the corresponding receiving passageways; and a protective member assembled to the front side of the terminal block; and wherein the protective member defines a plurality of channels corresponding to the receiving passageways, said contacting portions of the terminals are entirely received in the channels of the protective member, respectively;

wherein each size of the channel is respective larger than that of the contacting portion of the corresponding terminal and smaller than that of the media portion, therefore, the channels can allow the contacting portion to enter therein and stop the media portion from entering into the channels;

a front cover made of metal or magnetic material and capable of being attracted by a complementary connector, and wherein the front cover is assembled with the terminal block and the protective member.

2. The electrical connector as claimed in claim 1, wherein the front cover defines a receiving cavity for receiving the terminal block and the protective member therein and a front opening communicating with the receiving cavity.

3. The electrical connector as claimed in claim 2, wherein the size of the front opening is smaller than that of the receiving cavity, and therefore a step portion is formed therebetween; and wherein the protective member is of step-shape, and partially received in the receiving cavity of the front cover and defines an enlarged portion positioned by said step portion of the franc cover, a forward portion extending forwardly from the enlarged portion and projecting beyond the front opening of the front cover and the plurality of channels extending through the enlarged portion and the forward portion.

4. The electrical connector as claimed in claim 3, wherein the terminal block defines a rectangular base portion exposed outside the receiving cavity of the front cover, a tongue portion extending forwardly from the front end of the base portion and received in the receiving cavity for engaging with the enlarged portion of the protective member and the plurality of passageways extending through the base portion and the tongue portion.

5. The electrical connector as claimed in claim 4, wherein the tongue portion of the terminal block defines a pair of first holes passing through the tongue portion along a direction perpendicular to the passageways; and wherein the front cover further defines a pair of second holes corresponding to the first holes; and further comprising a pair of retaining pins engaging with said a pair of first holes and second holes for locking the front cover and the terminal block together.

6. The electrical connector as claimed in claim 1, further comprising a circuit board located behind the terminal block, and wherein the circuit board defining a plurality of conductive elements for electrically connecting with the plurality of terminals and at least an LED (Low Emitting Diode) electrically formed on the circuit board.

7. The electrical connector as claimed in claim 6, further comprising an IC (Integrated Circuit) driving the LED to emit different light to indicate the status of the electric circuit.

8. The electrical connector as claimed in claim 7, wherein the terminals are of POGO-type and comprise a plurality of power terminals and at least a detective terminal electrically connecting with the LED for indicating the status of the electric circuit.

9. The electrical connector as claimed in claim 8, further comprising an inner casing, and wherein the inner casing is formed by means of at least one of injection and molding from transparent or semitransparent material.

10. The electrical connector as claimed in claim 9, wherein the inner casing is of rectangular shape and molded with the circuit board and the base portion of the terminal block.

11. The electrical connector as claimed in claim 10, further comprising a cover defining a receiving space accommodating the assembly of the inner casing, the circuit board and the terminal block, and wherein the cover also defines a pair of circular holes both at top and bottom wall thereof respectively for facilitating to watch the light emitted by the LED.

12. An electrical connector, comprising:

a front cover defining a mating port;

a terminal block assembled with a plurality of terminals and partially positioned in the mating port;

a protective member disposed in front of the terminal block and partially received in the mating port, with a forward portion thereof extending beyond a front surface of the front cover; and wherein each terminal defines a media portion positioned in the terminal block and a contacting portion extending forwardly from the media portion, said contacting portion of the terminal is completely accommodated in corresponding channel of the protective member;

a circuit board located behind the terminal block, and wherein the circuit board defining a plurality of conductive elements for electrically connecting with the plurality of terminals and at least an LED (Low Emitting Diode) electrically formed on the circuit board.

13. The electrical connector as claimed in claim 12, wherein each size of the channel is respective larger then that of the contacting portion of the corresponding terminal and smaller than that of the media portion, therefore, the channels can allow the contacting portion to enter therein and stop the media portion from entering into the channels.

14. The electrical connector as claimed in claim 12, wherein the terminals are of POGO-type and comprise a plurality of power terminals and at least a detective terminal electrically connecting with the LED for indicating the status of the electric circuit.

15. The electrical connector as claimed in claim 12, wherein said protective member abuts against the terminal block in a front-to-back direction when contacting portions are received in the corresponding channels, respectively.

16. The electrical connector as claimed in claim 12, wherein the mating port includes a receiving cavity and a front opening, said receiving cavity is larger than the front opening, wherein the protective member has an enlarged portion at back of the forward portion and retained in the receiving cavity.

* * * * *

UNITED STATES PATENT AND TRADEMARK OFFICE

CERTIFICATE OF CORRECTION

PATENT NO. : 7,632,134 B2
APPLICATION NO. : 11/824761
DATED : December 15, 2009
INVENTOR(S) : Ping-Sheng Su et al.

It is certified that error appears in the above-identified patent and that said Letters Patent is hereby corrected as shown below:

In column 2, line 49, delete “therethough” and insert -- therethrough --, therefor.

In column 3, line 48, delete “rewardly” and insert -- rearwardly --, therefor.

In column 3, line 61, delete “1 12” and insert -- 112 --, therefor.

In column 4, line 13, delete “131,” and insert -- 131. --, therefor.

In column 5, line 9, in Claim 3, delete “franc” and insert -- front --, therefor.

In column 6, line 29, in Claim 3, delete “then” and insert -- than --, therefor.

Signed and Sealed this
Twenty-second Day of November, 2011

David J. Kappos

David J. Kappos
*Director of the United States Patent and Trademark Office*